United States Patent [19]

Thekdi et al.

[11] 4,214,866

[45] Jul. 29, 1980

[54] BURNER FOR HIGH TEMPERATURE COMBUSTION AIR

[75] Inventors: Arvind C. Thekdi; Klaus H. Hemsath, both of Sylvania, Ohio; Frank J. Vereecke, Palmyra, Mich.

[73] Assignee: Midland-Ross Corporation, Cleveland, Ohio

[21] Appl. No.: 966,873

[22] Filed: Dec. 6, 1978

[51] Int. Cl.[3] ..... F27D 17/00; F27B 3/22

[52] U.S. Cl. ..... 432/12; 266/254; 431/186; 432/29; 432/48; 432/179; 432/189; 432/196; 432/222

[58] Field of Search ..... 432/12, 28, 29, 222, 432/179, 189, 196, 48; 431/186; 266/254, 83

[56] References Cited

U.S. PATENT DOCUMENTS

| | | | |
|---|---|---|---|
| 2,171,353 | 8/1939 | Brassert | 432/29 |
| 2,689,722 | 9/1954 | Knight | 432/163 |
| 2,849,221 | 8/1958 | Cone et al. | 432/12 |
| 2,991,832 | 7/1961 | Dailey, Jr. | 432/48 |
| 3,107,904 | 10/1963 | Dailey, Jr. | 432/49 |
| 3,199,852 | 8/1965 | Koinis et al. | 431/76 |
| 4,027,642 | 6/1977 | Kamada et al. | 432/222 |
| 4,060,380 | 11/1977 | Bolt | 432/222 |

FOREIGN PATENT DOCUMENTS

| | | | |
|---|---|---|---|
| 220889 | 3/1958 | Australia | 432/222 |

*Primary Examiner*—John J. Camby
*Attorney, Agent, or Firm*—Richard A. Negin

[57] ABSTRACT

A burner within which there is a jet pump means. High pressure primary combustion air is fed to an inlet in the burner housing and then through the jet pump means. The high pressure air flowing through the jet pump means draws a secondary low pressure, high temperature air into the burner. The jet pump means entrains the secondary air within the primary air to form a combustion air mixture. A fuel means feeds fuel to the burner housing and the combustion air and fuel combine to form a suitable mixture for ignition. A swirler can be located within the means to feed the primary air to the inlet or within the burner itself. By swirling the primary air the flame pattern of the burner can be controlled. The burner of the present invention is particularly adaptable for soaking pits having a tile recuperator and the metallic recuperator disposed within a flue gas passageway.

20 Claims, 7 Drawing Figures

BURNER FOR HIGH TEMPERATURE COMBUSTION AIR

BACKGROUND OF THE INVENTION

This invention is in the field of burners; more particularly, the invention relates to high temperature burners suited for use in soaking pits for heating partially chilled or cold steel ingots to a uniform temperature for rolling.

In the operation of soaking pits, a number of ingots are ordinarily charged into the heating chamber and removed after they have attained proper temperature. The heating chamber is heated by hot combustion gases from a burner which is generally located in the wall of the upper portion of the chamber. The combustion gases travel across the top of the chamber and then back through the lower portion and out through exhaust ports located in the wall of the lower portion of the chamber.

It is desirable to utilize the heat in the flue gases to preheat combustion air for the soaking pit combustion system. This is accomplished by having suitable recuperators through which the flue products pass in a heat transfer relationship with incoming combustion air.

The flue gas leaving the combustion and heating chamber of the soaking pit furnace is on the order of magnitude of 2400° F. Recuperator systems are known in the art which can withstand the deleterious affects of the high temperature flue gas and capture the heat carried within the flue gas for use in the soaking pit furnace. A discussion of the prior art concerning soaking pit and recuperator systems will be helpful in understanding the present invention.

U.S. Pat. No. 3,107,904 by W. H. Dailey, Jr. and U.S. Pat. No. 3,199,852 by F. J. Koinis et al describe soaking pit systems of interest. The soaking pit systems described in these patents contain certain basic features including: a heating chamber, a recuperator through which the flue gas passes heating secondary combustion air; a stack through which the flue gas leaves the system; a source of primary air; a means to heat the primary air; a burner; a jet pump through which the primary air blows to the burner, drawing secondary air through the recuperator; and a means to control the ratio of primary to secondary air. The soaking pits described in these two patents use a tile recuperator which is common to a plurality of heating and combustion chambers. However, in both of these patents the jet pump or venturi tube is separate from the burner.

U.S. Pat. No. 2,849,221 by C. Cone describes a heat treating furnace in which there is a means to recirculate heating chamber gases when the heating burner is off. A second burner is fired into an auxiliary chamber and gases at high velocity from the chamber pass through an opening duct and then into tubes which lead into the heating chamber of the furnace. These high velocity gases draw some of the exhaust gases from the heating chamber through the opening duct by an inspiration effect and recirculate them through the tubes back into the furnace chamber. The remaining exhaust gases from the furnace chamber pass through a tile and a metal recuperator and then out of stack. The recirculated furnace gases in this patent are not brought into contact with the second burner. The primary air passing through a jet pump draws secondary air through a tile recuperator, entrains it and carries it to the heating burner. The secondary air is drawn by the jet pump, which is discrete from the heating burner, and is not drawn directly into the heating burner or second burner.

U.S. Pat. No. 2,991,832 by W. H. Dailey, Jr. describes a heat treating furnace in which exhaust gases from the soaking pit of the furnace pass through a tile recuperator and then a metal recuperator and finally exit an exhaust stack. Primary combustion air is delivered, under pressure, to the intake side of the metal recuperator by a motor driven blower. The primary air passes from the metal recuperator to a jet pump which is separate from the burner. The jet pump draws secondary air through the tile recuperator and entrains it with the higher pressure primary air. The combustion air passes to a burner located on the side of the furnace. The heating flame enters the furnace chamber from a firing port which preferably has a venturi construction. There is a second jet pump open to the passage connecting the exhaust flue with the firing port. The inlet of the firing port is coincident with the outlet of the burner which has an independent supply of combustion air and fuel. A portion of the primary combustion air is delivered to the firing port through the second jet pump which is in communication with the exhaust flue. The primary air is introduced into the second jet pump through a nozzle and draws part of the products of combustion through the exhaust jet pump to the firing port by the inspirating effect of the high velocity of air discharged through the nozzle. Thereby the furnace atmosphere is recycled as the burner is turned down. The burner is not designed or used as a jet pump to draw secondary air through the recuperator and to the burner, itself or for mixing the primary air with the secondary air.

U.S. Pat. No. 2,689,722 by P. L. Knight also shows a heating apparatus for soaking pits. A plurality of soaking pit heating and combustion chambers are shown each having a separate recuperator. U.S. Pat. No. 2,171,353 by H. A. Brassert is a method for utilization of waste heat using two recuperators in series, a tile recuperator and a metal recuperator. This patent notes that the waste gases from soaking pits are at much higher temperatures than the available metal tube recuperators can withstand. Gaseous material to be heated to higher temperatures pass through the tile recuperator cooling the flue gases passing through the tile recuperator to the metal recuperator. Gases to be heated to lower temperatures pass through the metal recuperator to capture heat from the cooler flue gases passing through the metal recuperator to an exhaust means.

Soaking pit furnace systems are known which use both tile and metal recuperators disposed within an exhaust passage from the heating chamber which leads to an exhaust means. Such furnaces have burners which receive combustion air from a jet pump means. Lower temperature, higher pressure, primary combustion air is heated in the metal recuperator and fed through the jet pump to the burner at a relatively high velocity. This primary air draws lower pressure secondary air through the higher temperature tile recuperator and entrains it within the combustion air stream which is fed to the burner. The jet pump is made of metal and like the metal recuperator and cannot stand the high temperatures of the waste gases coming out of the soaking pit. Therefore, there is a limit to the temperature of the high temperature secondary air and the ratio of the primary and secondary air which can go into the metallic jet pump. As a result, the temperature of combustion air going to the burner is limited and, therefore, the temperature of the flame is limited.

The separate jet pump has been used in order to take advantage of the heat in the secondary air which passed through the tile recuperator. The pressure of the secondary air is limited by the tile recuperator. The secondary air pressure cannot vary greatly from the flue gas pressure in the tile recuperator or the pressure difference across the walls separating the two gases, secondary air and flue gases, will be more than the structure of the tile recuperator can withstand. The pressure necessary for a practical flame in the soaking pit is supplied by lower temperature primary air which passes through a metal recuperator. The metal recuperator can structurally withstand greater pressures but not greater temperatures than a tile recuperator. As indicated, a jet pump has been used in higher pressure, lower temperature primary air lines to draw the lower pressure secondary air through the tile recuperator for mixture with the primary air. Thereby resulting in higher temperature combustion air for a hotter flame. The jet pumps are made of metal and the amount of secondary air which they can draw is, therefore, limited by the same temperature constraints as the metal recuperators.

Thus, there is a need to more efficiently use the heat of the flue gases coming from the heating and combustion chamber of a soaking pit to heat combustion air and thereby result in a higher temperature flame without the use of additional fuel. It is desirable to overcome the limits of combustion air temperature imposed particularly by the metallic jet pump.

SUMMARY OF THE INVENTION

The present invention is a burner having a housing within which there is a jet pump means. High pressure primary combustion air is fed to an inlet in the housing and through the jet pump means. The high pressure air flowing through the jet pump means draws a secondary low pressure, high temperature air into the burner. The jet pump means entrains the secondary air within the primary air to form a combustion air mixture. A fuel means feeds fuel to the burner housing and the combustion air and fuel combine to form a suitable mixture for ignition. Any suitable ignition means known in the art can be used to ignite the burner. A swirler can be located within the means to feed the primary air to the inlet or within the burner itself. By swirling the primary air the flame pattern of the burner can be controlled. The burner of the present invention is particularly adaptable for soaking pits having a tile recuperator and the metallic recuperator disposed within a flue gas passageway. High pressure lower temperature primary air passes through the metallic recuperator and lower pressure high temperature secondary air is drawn through the tile recuperator.

It is the general object of the present invention to provide an improved burner containing a jet pump means through which low temperature high pressure primary air can entrain a high temperature low pressure secondary air in a combustion air stream for a combination with fuel from a fuel means for ignition. It is another general object of this invention to use the burner of the invention in an improved soaking pit apparatus.

It is an object of the present invention to control the flame pattern of the burner with a swirler located before the jet pump in the primary air path. It is a further object of the present invention to adjust the direction which the primary air flows through the swirler. The means to adjust preferably being outside of the burner.

It is a further object of the present invention to provide a method for operating a burner by feeding high pressure primary air through a jet pump located within the burner housing. This primary air draws low pressure high temperature secondary air into the burner with the jet pump thereby entraining the secondary air within the primary air and forming a combustion air mixture. It is a particular object to be able to operate the burner with primary air at temperatures at least as high as 1200° F., with secondary air at temperatures at least as high as 2400° F. and with a combustion air mixture at temperatures at least as high as 1750° F.

An object of the present invention is to use the improved burner in a soaking pit apparatus of the type having at least one tile recuperator and at least one metal recuperator disposed within the flue gas passage. Another object of the present invention is to pass primary air through the metallic recuperator and into the jet pump of the improved burner thereby drawing low pressure high temperature secondary air through at least one tile recuperator and entraining it within the primary air stream through the jet pump within the burner.

It is an object of this invention to obtain one or more of the objects set forth above. These and other objects and advantages of this invention will become apparent to those skilled in the art from the following specification and claims, reference being had to the attached drawings.

DESCRIPTION OF THE PREFERRED EMBODIMENT

Figure 1:
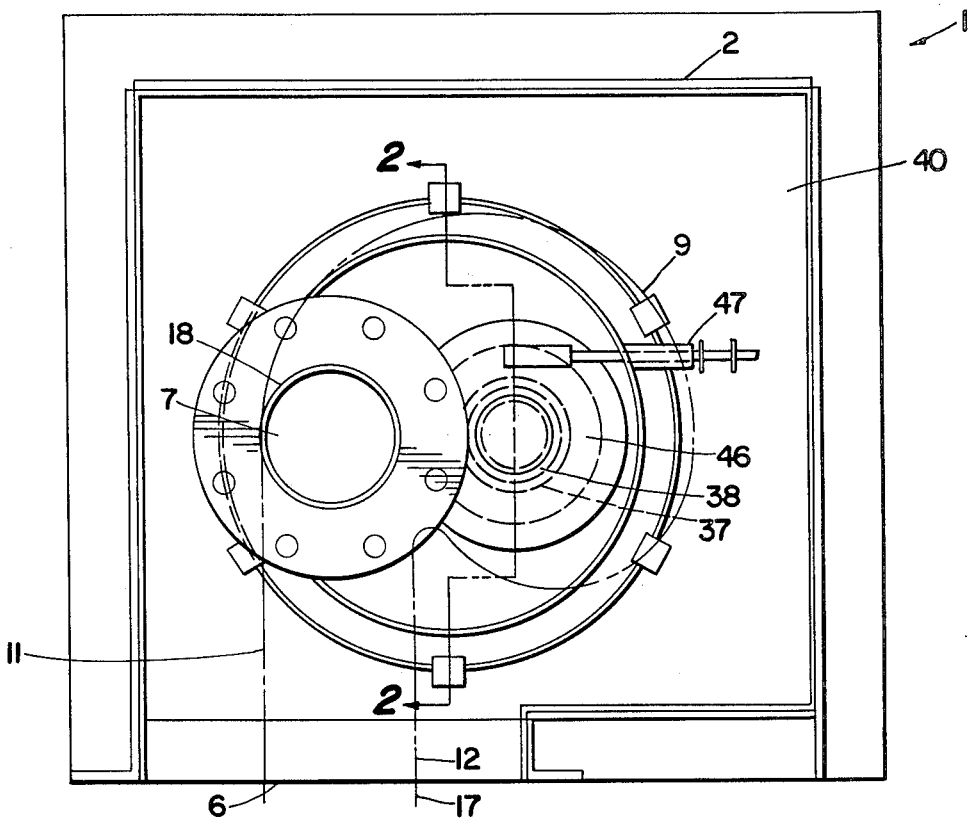
FIG. 1 is a view along the longitudinal axis of the burner of the present invention (Some detail shown in FIG. 2 is eliminated in FIG. 1 for clarity).
Figure 3:
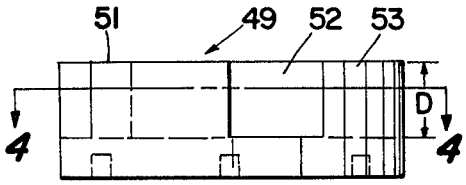
FIG. 3 is the front view of the first swirler disc of the present invention.
Figure 5:
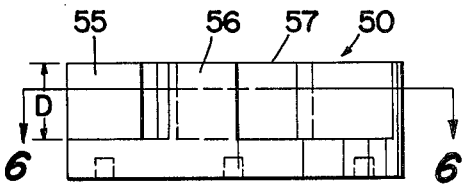
FIG. 5 is the front view of the second swirler disc of the present invention.
Figure 4:
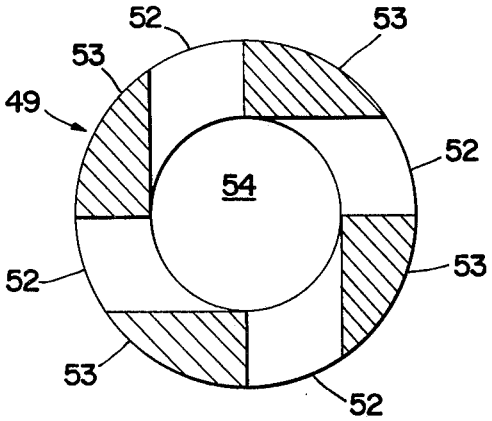
FIG. 4 is a sectional view along 4—4 of FIG. 3.
Figure 6:
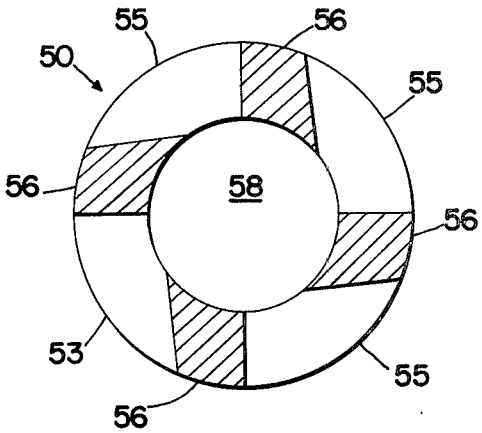
FIG. 6 is a sectional view along 6—6 of FIG. 5.
Figure 2:
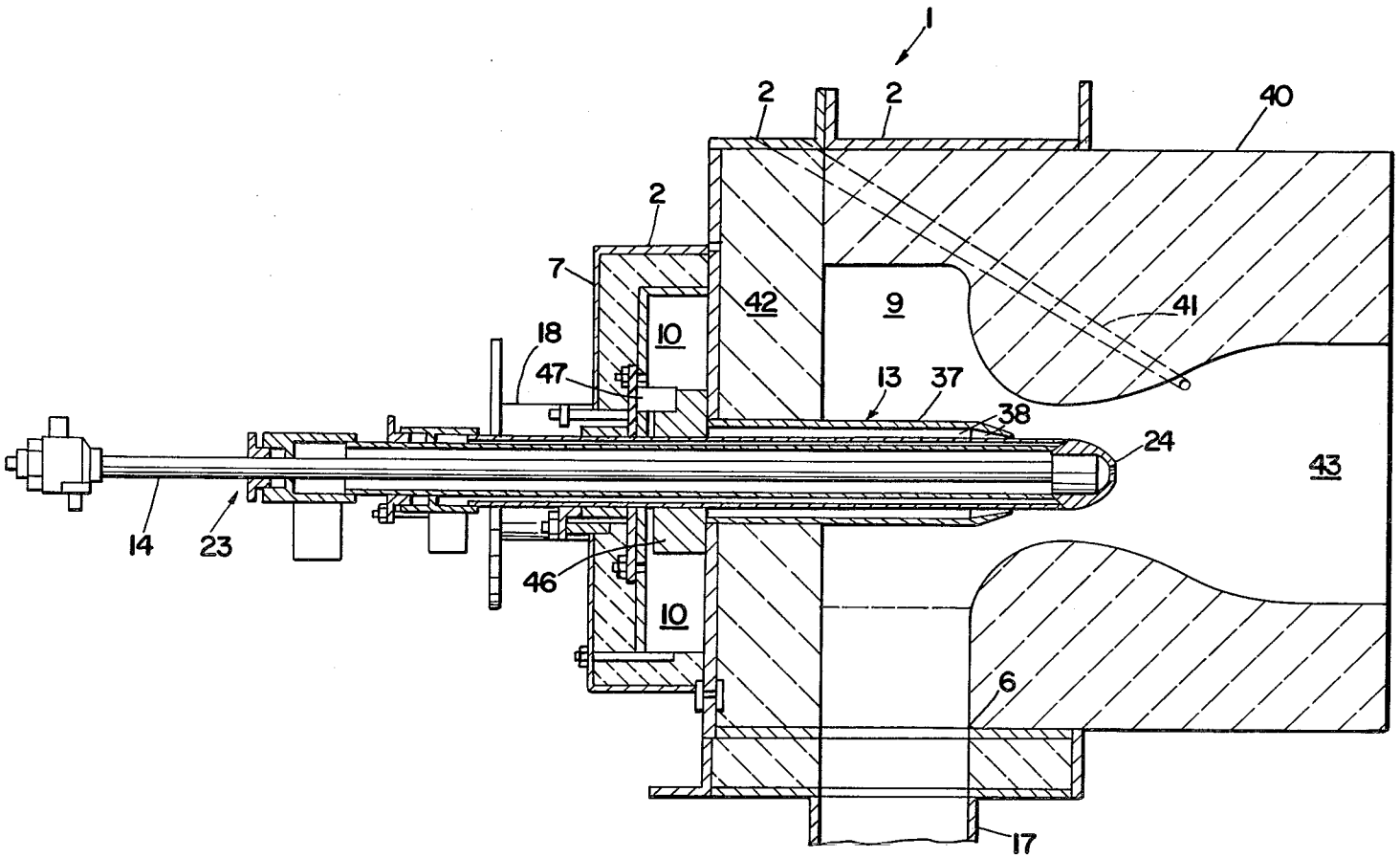
FIG. 2 is a sectional view along 2—2 of FIG. 1.

The improved burner of the present invention will be understood by those skilled in the art by reference to FIGS. 1 and 2 which illustrate the preferred embodiment of the present invention.

The burner 1 has a housing 2. There is a primary air inlet 7 communicating through housing 2 into a high pressure chamber 10. The fuel feed means such as a fuel pipe 14, having an entrance portion 23, is sealingly attached to the housing 2. The fuel pipe 14 extends longitudinally through the housing to a fuel pipe exit end 24. A secondary air inlet 6 passes through housing 2 into a low pressure chamber 9. The preferred configuration of the low pressure chamber 9 is the spiral as shown in FIG. 1. The secondary air inlet 6 is off-center from the axis of the fuel pipe 14 which passes through the low pressure chamber 9. The distance from the wall of the low pressure chamber to the axis of fuel pipe 14 continually decreases in a spiral fashion as the wall curves from the outer wall 11 back to the inner wall 12 of the secondary air inlet 6. The high pressure chamber 10 communicates with the low pressure chamber 9 through a jet pump means 13. A means to bring primary air, such as a primary air feed pipe 18, is connected to primary air inlet 7 and a means to bring secondary air, such as a secondary air feed pipe 17, is connected to secondary air inlet 6.

Preferably the jet pump means 13 is located within the low pressure chamber 9 mounted to a partition 42 between the high pressure chamber 10 and the low pressure chamber 9. The jet pump means 13 is a jet tube 37 concentrically mounted about the fuel feed pipe 14 so that there is a jet pump annular space 38 between the inside of the jet tube 37 and the outside of the fuel feed pipe 14. There is a communication between the primary air inlet 7, the high pressure chamber 10, the jet pump annular space 38 and the low pressure chamber 9 into a burner block combustion chamber 43. The jet tube 37 must be concentrically mounted about the fuel feed pipe 14 to assure uniform combustion air distribution. As shown in FIG. 2, the preferred configuration of the jet tube 37 is an annular tube with a decrease in diameter at the outlet of annular space 38. This results in an increase in velocity needed for a jet pump. The portion of the jet tube 37 with a greater diameter minimizes the pressure drop of the primary air as it passes through the jet pump 13.

The jet tube 37 can be made of a suitable material, such as high quality metal or ceramic. The jet tube 37 does not encounter the same high temperature problems as the metallic jet pumps in soaking pits of the prior art. Although it is exposed to high temperature secondary air in the low pressure chamber 9. Cooler primary air at higher pressure and high velocity is passing through annular space 38 keeping the jet tube 37 cool.

A swirler 46 is diposed between the high pressure chamber 10 and the jet pump means 13. Primary air from the primary air inlet 7 can then flow through the high pressure chamber 10 and be swirled at the swirler 46 and then flow through jet pump means 13 into the burner block combustion chamber 43. The swirler has a means 47 to adjust the swirl angle which the primary air will have upon flowing from the swirler 46 to the burner block combustion chamber 43.

The swirler 46 of the preferred embodiment of the present invention is shown in FIGS. 1 through 6 should not limit the scope of the present invention. Any suitable swirler known in the art can be used. The preferred swirler 46 is composed of a first swirler disc 49 and a second swirler disc 50. The swirler 46 is preferably located within high pressure air chamber 10 mounted concentrically about fuel pipe 14. The first swirler disc 49 has a concentric hole 54 and the second swirler disc 50 has a concentric hole 58. First swirler disc 49 has a plurality of first swirler disc cutouts 52 from the outside to the inside circumferences at a uniform distance D from the top 51 of the first swirler disc 49 leaving a plurality of first swirler disc extensions 53. Second swirler disc 50 has a plurality of second swirler disc cutouts 55 from the outside to the inside circumference at a uniform distance D from the top 57 of the second swirler disc 50 leaving a plurality of second swirler disc extensions 56. The first swirler disc cutouts 52 correspond to second swirler disc extensions 56 and second swirler disc cutouts 55 correspond to first swirler disc extensions 56 upon assembly as shown in FIGS. 1 and 2. First swirler disc 49 and second swirler disc 50 are mounted concentrically about fuel pipe 14 which fits through first and second swirler disc holes 54,58, so that corresponding cutouts and extensions fit together. The relative sizes of the corresponding extensions and cutouts being of dimensions so that there are passageways between first and second disc extensions on assembly. By rotating one swirler disc relative to the other the direction of the passageway changes and swirl angle of the air through the swirler to the jet pump can thereby be adjusted from the limits of being perpendicular to the feed fuel pipe 14 to almost tangential to the feed pipe 14. The swirl of the primary air can, therefore, be varied from tangential to axial with respect to the longitudinal axis of the burner thereby controlling the heating pattern of the flame.

The preferred means 47 to rotate one swirler disc relative to the other and thereby adjust the swirl angle of the swirler is shown in FIGS. 1 and 2. The means 47 extends to outside the burner housing 2. By using this means or other suitable means the first and second swirler discs can be manually or automatically controlled from outside of the burner housing.

The swirler 46 affects the flame pattern of the burner. Without the use of a swirler, the angle of divergence of the flame is approximately 20°, where the angle of divergence is double the angle between the burner and flame axis and the approximate surface of the flame. Without the use of a swirler, a flame having an angle of divergence of about 20° will result in non-uniform heating in an application such as a soaking pit. The swirler provides a tangential component thereby enabling the angle of divergence to increase. By controlling the angle of the swirler the angle of divergence of the flame and thereby the flame pattern can be controlled.

A burner block 40 made of suitable refractory material is mounted on housing 2. Burner block 40 has an ignition means such as spark plug 41 disposed at an appropriate location on the burner block 40 to ignite the mixture of combustion air and fuel brought to the burner block combustion chamber 43. The burner block 40 has a preferred configuration as shown in FIG. 2 but the present invention should not be limited by the burner block configuration and ignition means as shown in this preferred embodiment.

Figure 7:
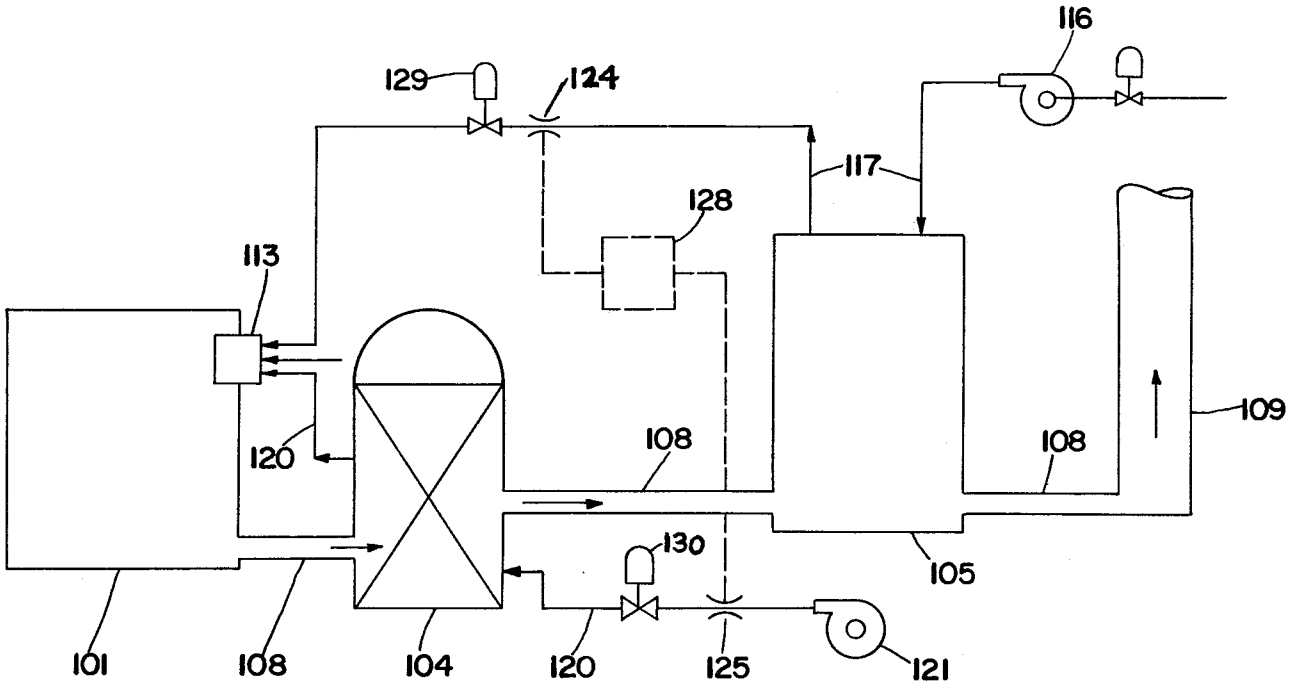
FIG. 7 is a schematic diagram of the soaking pit system encompassing the burner of the present invention.

The burner of the present invention is used in an improved soaking pit as shown in the schematic diagram in FIG. 7. The soaking pit system can have one or more heating chambers 101. Flue gas passes through a flue gas passage 108 to an exhaust means such as a stack 109. Within the flue gas passage 108 can be disposed a tile recuperator 104 and a metallic recuperator 105. Preferably, there is one tile recuperator 104 for each heating chamber 101. There can be one metallic recuperator 105 which services the whole soaking pit system or there can be a metallic recuperator 105 for each heating chamber 101.

Each heating chamber 101 has a burner 113 associated with it. Burner 113 can be of the type shown in FIGS. 1 and 2. Further description of the burner 113 of the soaking pit system shown in FIG. 7 will reference burner parts to the burner 1 as shown in FIGS. 1 and 2.

A suitable means to force air such as a primary air blower 116 forces primary air through a primary air line 117 to the primary air feed pipe 18 of burner 113. Disposed within primary air line 117 can be the metallic recuperator 105.

A secondary air line 120 brings secondary air to the secondary air feed pipe 17 of burner 113. Disposed within the secondary air line 120 can be the tile recuperator 104. Although the secondary air can be drawn into the burner 113 by the inspirating effect of jet pump means 13, a means to force secondary air into secondary air line 120, such as secondary air blower 121 can be provided. A primary air flow measuring means is disposed within primary air line 117 and a secondary air flow measuring means is disposed within secondary air line 120. The flow measurements taken from primary air flow measuring means 124 and secondary air flow measuring means 125 are monitored. A ratio controller means 128 can be set so that a ratio of primary to secondary air is maintained and controlled. The monitored flow rates of the primary and secondary air are brought to the ratio controller means 128 and compared. The ratio controller means can then signal a primary air valve means 129 disposed within the primary air line 117 and a secondary air valve means 130 disposed within secondary air line 120. The primary air valve means 129 and the secondary air valve means 130 respond according to the signal from the ratio controller means to assure that the proper primary to secondary air ratio and total volume of primary and secondary air are maintained. Additionally, there are pressure measuring devices disposed within the primary air lines 117 and secondary air line 120 which monitor primary and secondary air pressure and can be used to control the flow rates of primary and secondary air as desired. The flow rate and pressure measuring means in combination with suitable control systems are known in the art.

The unique way in which the improved burner of the present invention cooperates with the soaking pit system as described will be more clearly illustrated by the discussion of the method of operation below.

METHOD OF OPERATION

As shown in FIGS. 1 and 2, the burner 1 of the present invention is operated by feeding high pressure primary air to the burner 1 through a jet pump means 13 located within the burner housing 2. The primary air draws low pressure, high temperature secondary air into the burner by the inspiration effect of the jet pump means 13. The secondary air becomes entrained within the jet stream of the primary air. The primary air with the secondary air is passed to burner block combustion chamber 43. Fuel is fed into the burner by a suitable fuel feed means such as fuel feed pipe 14 where it mixes with the combustion air mixture of primary and secondary air upon entry to the burner block combustion chamber 43. Additionally, the primary air can be swirled before it enters the jet pump means 13 by a suitable swirler means 46. The swirler 46 is located upstream from the jet pump means 13 within the burner housing. The combustion air and fuel mix on entry into burner block chamber 43 and are ignited by a suitable ignition means such as a pilot or spark plug 41.

The present invention has control of the turndown ratio via the two air streams. The turndown ratio is the ratio of the maximum heat output to the actual or desired heat output. The burner arrangement of the present invention can have a turndown of up to 5 to 1 without significantly affecting the jet pump and, therefore, the momentum of the hot gases. Because most of the momentum is supplied by the primary high pressure, high velocity, low temperature air, the heat input can be reduced considerably without loss of momentum by maintaining the primary air flow and reducing the low pressure, high temperature air flow which carries more of the heat to the burner.

The method of operation of the burner 1 as shown in FIGS. 1 and 2 will be described considering the conditions which such a burner might typically see when used in association with the heating chamber of a soaking pit. High pressure primary air is fed to the burner 1 through the jet pump means 13 located within the burner housing. Typically, the high pressure primary air is between two and five psig (pounds per square inch gauge) and is heated up to about 1200° F. The primary air flowing through the jet pump draws low pressure, high temperature secondary air into the burner with the jet pump means 13. Typically, in a soaking pit process, the low pressure secondary air is between −1 and +1 inches water column and is heated up to about 2200° F. The secondary air is entrained within the primary air stream within the burner. The ratio of the primary to secondary air can be adjusted outside of the burner. The ratio can vary widely depending on temperature requirements and pressure of the air streams. Fuel is fed to the burner 1 by a suitable fuel feed means, such as a fuel feed pipe 14. The fuel feeds through the fuel feed pipe 14 to the fuel feed pipe end 24. At the fuel feed pipe end 24 within burner block combustion chamber 43 the fuel and combustion air mix. A suitable ignition means, such as spark plug 41, ignites the fuel and combustion air mixture.

The primary air can be swirled before reaching jet pump means 13. Preferably the swirler 46 is located within the high pressure chamber 10 of the burner 1. The high pressure air passes through the primary air feed pipe 18 to the primary air inlet 7 and then through swirler 46 to jet pump 13. The swirling of the primary air is the means by which the flame heat pattern from the burner can be controlled. Preferably, the swirler 46 can be adjusted from outside the burner housing to control the flame pattern. The primary air flows through the swirler and can be adjusted so that the direction of the swirl of the primary air coming from the swirler can vary from perpendicular to the fuel pipe 14 to almost tangential the fuel pipe 14. The swirl of primary air can, therefore, be varied from almost tangential to axial with respect to the longitudinal axis of the burner thereby controlling the heating pattern of the flame. In the particular application to soaking pit operations, the burner must be able to be controlled so that there is a minimum temperature gradient from end to end of the soaking pit. Therefore, the burner of the present invention for use in soaking pits should have a swirler which can control the heat release pattern of the flame.

The momentum of the products of combustion coming from the burner can be controlled by adjusting the ratio of primary and secondary air to the burner. The entrainment of secondary air and fuel within the jet stream is a function of the axial momentum and, therefore, can be controlled by controlling the flow of primary air through the jet pump.

The burner of the present invention operates at temperatures which permit it to be constructed from suitable materials used in the art to make burners. In addition to the cooling effect of the primary air through the jet tube 37, as noted above, under typical operating conditions in a soaking pit furnace, flame ignition takes place somewhat beyond the end of the burner block 40 where aerodynamic stabilization occurs. With ignition and combustion beyond the burner, the burner is not in direct contact with the higher temperature flame moving away from it. The burner 1 will produce a flame with a temperature as high as 4200° F. while burners of the prior art in similar application would only produce a flame on the order of 3400° F. using the same fuel requirement.

In a typical soaking pit system in which the burner 1 is used, exhaust gases as high as 2400° F. pass through a tile recuperator, a metal recuperator and finally to an exhaust stack. Primary air from the primary air blower 116 is forced through a metal recuperator 105 to the primary air feed pipe 18 of burner 113. The primary air is between 3 and 5 psig and heated to about 1200° F. upon leaving the metallic recuperator 105. The secondary air is drawn through the tile recuperator and into the burner by the jet pump means 13 within the burner and/or can be blown by a secondary air blower 121 into the secondary feed pipe 17 of the burner 113. The secondary air passes through a tile recuperator and is between −1 and +1 inches water column and at approximately 2200° F. when it enters the secondary air feed pipe 13 of burner 113. The mixture of combustion air in the burner of the present invention is about 1750° F. A ratio controller 128 can be set to control the ratio of the primary air to the secondary air. The flow rate of primary and secondary air to the system can be suitably controlled by controlling the amount of air forced into the system by the primary air blower 116. The ratio of primary to secondary air and the flow rate of primary and secondary air can be used to affect and control momentum of the products of combustion.

It will be obvious to those skilled in the art that the construction and operation of the present invention should not be limited to particular burner block configurations and that the novelty of the present invention lies in a jet pump built within the burner of the present invention.

In prior art systems which use a metallic jet pump separate from the burner, temperatures of the gases are limited. In a typical soaking pit the primary air can only be heated to about 800° F. and the secondary air to only about 1400° F. The mixture of combustion air to the burner is at a temperature of about 1000° F. which is lower than the combustion air mixture in the burner of the present invention which is at about 1750° F., as noted.

Modifications, changes and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein, but rather should be limited by the advance of which the invention has promoted the art.

What is claimed is:

1. A burner which comprises:

a housing;

a burner block mounted on the housing having a combustion chamber;

a primary high pressure combustion air inlet to the housing;

a low pressure chamber in the housing in communication with the primary air inlet;

a secondary air inlet to the low pressure chamber;

a jet pump means through which the primary air inlet communicates to the low pressure chamber, the jet pump means being directed to cause primary air to flow into the combustion chamber;

a fuel feed means to feed fuel into the combustion chamber;

a means to ignite the combustion air and fuel brought to the combustion chamber.

2. A burner as recited in claim 1 which further comprises:

a high pressure chamber between the primary air inlet and the low pressure chamber;

a swirler between the high pressure chamber and the jet pump means through which the primary air flows.

3. A burner as recited in claim 2 wherein the fuel feed means comprises:

a fuel pipe extending through the housing into the burner block, the fuel pipe having an entrance portion and an exit end, and the entrance portion sealingly attached to the housing.

4. A burner as recited in claim 3 wherein the secondary air inlet has an inner wall and an outer wall and is off-center from the axis of the fuel pipe whose axis is within the low pressure chamber and the distance of the wall of the low pressure chamber to the fuel pipe axis continually decreases in a spiral fashion as the wall curves from the outer wall back to the inner wall of the secondary air inlet.

5. A burner as recited in claim 3 wherein the swirler further comprises:

a first swirler disc having a plurality of first swirler disc cutouts from the outside circumference to the inside circumference at a uniform distance from the top of the first swirler disc leaving a plurality of first swirler disc extensions and having a concentric hole;

a second swirler disc having a plurality of second swirler disc cutouts from the outside circumference to the inside circumference at a uniform distance from the top of the second swirler disc leaving a plurality of second swirler disc extensions and having a concentric hole, the second swirler disc cutouts corresponding to the first swirler disc extensions and the second swirler disc extensions corresponding to the first swirler disc cutouts, the cutouts and extensions of the second swirler disc being fit to the corresponding cutouts and extensions of the first swirler disc, and the assembled first and second swirler discs being mounted concentrically about the fuel pipe which extends through the concentric holes in the first and second swirler disc, and the swirler discs being rotatable relative to each other, there being passageways between first and second disc extensions upon assembly so that by rotating one disc relative to the other the direction of the passageway changes.

6. The burner as recited in claim 5 wherein there is a means to rotate one swirler disc relative to the other, the means extends to outside of the burner housing.

7. A burner which comprises:

a housing;

a burner block mounted on the housing having a combustion chamber;

a fuel pipe, to feed fuel into the combustion chamber, extending through the housing into the burner block, the fuel pipe having an entrance portion and an exit end and the entrance portion sealingly attached to the housing;

a primary high pressure combustion air inlet to the housing;

a high pressure chamber within the housing in communication with the primary air inlet;
a low pressure chamber in the housing in communication with the high pressure chamber;
a secondary air inlet to the low pressure chamber;
a jet pump means between the high pressure chamber and the low pressure chamber, the jet pump means being directed to cause primary air to flow into the combustion chamber;
a swirler between the high pressure chamber and the jet pump means through which the primary air flows;
a means to adjust the direction which the primary air flows through the swirler which is external the housing of the burner.

8. A burner as recited in claim 7 wherein the jet pump comprises a jet tube, between the swirler and the low pressure chamber, mounted concentrically about the fuel pipe forming an annular space between the jet tube and the fuel pipe which communicates between the swirler and the low pressure chamber.

9. A method of operating a burner, having a burner housing having a primary air inlet and a secondary air inlet, a jet pump between the primary air inlet and the secondary air inlet, a burner block mounted on the housing and having a combustion chamber, and a fuel feed means, which comprises the steps of:
feeding high pressure primary air to the burner;
passing the primary air through a jet pump located within a burner housing;
drawing low pressure, high temperature, secondary air into the burner with the jet pump;
entraining the secondary air with the primary air within the burner block combustion chamber;
feeding fuel to the burner block combustion chamber through a fuel feed means;
mixing the fuel, primary air with secondary air mixture upon entry to the burner block combustion chamber;
igniting the fuel, primary air with secondary air mixture in the burner block chamber.

10. A method for operating a burner as recited in claim 9 wherein the burner further has a swirler located between the primary air inlet and the jet pump, further comprising the step of swirling the primary air through the swirler prior to being passed through the jet pump.

11. A method for operating a burner as recited in claim 10 further comprising the steps of:
adjusting the direction which the primary air flows through the swirler and thereby the amount of swirl imparted to the primary air upon entering the jet pump from outside the burner housing to control the flame pattern;
controlling the momentum of the products of combustion by adjusting the ratio of primary to secondary air and flow rates of primary and secondary air.

12. A method of operating a burner as recited in claim 11 wherein:
the high pressure primary air is between 2 and 5 psig and is up to about 1200° F.; and
the low pressure secondary air is between −1 and +1 in W.C. and is set up to about 2200° F.

13. An improved soaking pit apparatus of the type having a plurality of combustion and heating chambers, at least one tile recuperator, at least one metal recuperator, a flue gas passage from the combustion and heating chambers to a common exhaust means, the tile recuperators and metal recuperators being disposed in the flue gas passage wherein the improvement comprises:
a burner associated with each chamber which further comprises:
a housing;
a burner block mounted on the housing having a combustion chamber;
a primary high pressure combustion air inlet to the housing;
a low pressure chamber in the housing in communication with the primary air inlet;
a secondary air inlet to the low pressure chamber;
a jet pump means through which the primary air inlet communicates to the low pressure chamber the jet pump means being directed to cause primary air to flow into the combustion chamber;
a fuel feed means to feed fuel into the combustion chamber;
a means to ignite the combustion air and fuel brought to the combustion chamber;
a primary air passageway to the primary air inlet in communication with at least one metal recuperator;
a secondary air passageway to the secondary air inlet in communication with at least one tile recuperator;
a swirler located between the primary air passageway and the jet pump means through which primary air flows.

14. The improvement as recited in claim 13 wherein one tile recuperator is provided for each combustion chamber.

15. The improvement as recited in claim 13 wherein the burner further comprises:
a high pressure chamber between the primary air inlet and the low pressure chamber with the swirler located between the high pressure chamber and the jet pump means;
a means to adjust the direction which the primary air flows through the swirler which is outside the housing of the burner.

16. An method of operating a soaking pit having a plurality of combustion and heating chambers, at least one tile recuperator, at least one metal recuperator, a flue gas passage from the combustion and heating chambers to a common exhaust means, the tile recuperators and metal recuperators being disposed in the flue gas passage, a burner housing having a primary air inlet and a secondary air inlet, a jet pump between the primary air inlet and the secondary air inlet, a burner block mounted on the housing and having a combustion chamber, and a fuel feed means, which comprises the steps of:
passing high pressure primary air through at least one metal recuperator;
swirling the primary air through a swirler located between the primary air inlet and the jet pump;
feeding the primary air from the metal recuperator through a jet pump located within the burner;
drawing low pressure, high temperature, secondary air through at least one tile recuperator and into the burner with the jet pump;
entraining the secondary air within the primary air in the burner combustion chamber;
feeding fuel to the burner through a fuel feed means;
mixing the fuel, primary air with secondary air mixture upon entry to the burner combustion chamber;

igniting the fuel, primary air with secondary air mixture in the burner block combustion chamber.

17. The method as recited in claim 16 further comprising the steps of:

adjusting the direction which the primary air flows through the swirler and thereby the amount of swirl imparted to the primary air upon entering the jet pump from outside the burner housing to control the flame pattern;

controlling the momentum of the products of combustion by adjusting the ratio of primary to secondary air and flow rates of primary and secondary air.

18. The method as recited in claim 17 further comprises the step of measuring the ratio of primary to secondary air.

19. The method as recited in claim 17 wherein:

the pressure of the primary air entering the metal recuperator is 3 to 5 psig;

the pressure of the secondary air entering the tile recuperator is −1 to +1 in W.C.;

the primary air is heated up to about 1200° F. in the metallic recuperator;

the secondary air is heated to about 2200° F. in the tile recuperator.

20. The burner as recited in claim 3 wherein the exit end of the fuel pipe is located between the jet pump and the combustion chamber, and the means to ignite is located on the burner block.

* * * * *